US009575436B2

(12) United States Patent
Deprez et al.

(10) Patent No.: US 9,575,436 B2
(45) Date of Patent: Feb. 21, 2017

(54) METHOD OF DIGITALLY PRINTING AN IMAGE ON A SUBSTRATE AND SYSTEM THEREFOR

(71) Applicant: Xeikon IP B.V., Eede (NL)

(72) Inventors: Lode Erik Dries Deprez, Wachtebeke (BE); Werner Jozef Johan Op de Beeck, Putte (BE)

(73) Assignee: Xeikon IP B.V., Eede (NL)

( * ) Notice: Subject to any disclaimer, the term of this patent is extended or adjusted under 35 U.S.C. 154(b) by 0 days.

(21) Appl. No.: 14/909,617

(22) PCT Filed: Sep. 4, 2014

(86) PCT No.: PCT/NL2014/050600
§ 371 (c)(1),
(2) Date: Feb. 2, 2016

(87) PCT Pub. No.: WO2015/034352
PCT Pub. Date: Mar. 12, 2015

(65) Prior Publication Data

US 2016/0179036 A1 Jun. 23, 2016

(30) Foreign Application Priority Data

Sep. 4, 2013 (NL) ..... 2011381

(51) Int. Cl.
*G03G 21/00* (2006.01)
*G03G 15/11* (2006.01)

(52) U.S. Cl.
CPC ..... *G03G 15/11* (2013.01); *G03G 21/0088* (2013.01)

(58) Field of Classification Search
CPC ..... G03G 15/11; G03G 21/0088
USPC ..... 399/349, 348
See application file for complete search history.

(56) References Cited

U.S. PATENT DOCUMENTS 6,978,111 B2 * 12/2005 Nagata et al. ..... G03G 21/0088 399/348
7,590,368 B2 * 9/2009 Kamijo et al. ..... G03G 15/11 399/348
7,809,307 B2 * 10/2010 Fukumoto et al. .... G03G 15/11 399/249
8,005,383 B2 * 8/2011 Tanaka et al. ..... G03G 21/0088 399/249

(Continued)

FOREIGN PATENT DOCUMENTS

EP 2685320 A1 1/2014
EP 2685322 A1 1/2014

(Continued)

*Primary Examiner* — William J Royer
(74) *Attorney, Agent, or Firm* — The Webb Law Firm

(57) ABSTRACT

A digital printing system includes a development member in rotational contact with a further member for imagewise transferring liquid toner from the development member optionally via the further member to a substrate. The system is such that toner residue remains on the development member after the transfer. A treatment device is present for patternwise treatment of the toner residue on the development member, especially by addition of a dispersing agent to facilitate removal of the toner residue. A controller is present for controlling the patternwise treatment. A system is used for robust and continuous printing and is suitable for recycling of the toner residue into liquid toner.

20 Claims, 3 Drawing Sheets

(56) References Cited

U.S. PATENT DOCUMENTS

| | | | |
|---|---|---|---|
| 2011/0076052 | A1 | 3/2011 | Shiiya et al. |
| 2011/0206418 | A1 | 8/2011 | Hobo |
| 2011/0249990 | A1 | 10/2011 | Izawa et al. |

FOREIGN PATENT DOCUMENTS

| | | | |
|---|---|---|---|
| JP | 8110741 | A | 4/1996 |
| JP | 200391222 | A | 3/2003 |
| JP | 2005331856 | A | 12/2005 |
| NL | 2010581 | C | 10/2014 |

* cited by examiner

METHOD OF DIGITALLY PRINTING AN IMAGE ON A SUBSTRATE AND SYSTEM THEREFOR

CROSS-REFERENCE TO RELATED APPLICATIONS

This application is the United States national phase of International Application No. PCT/NL2014/050600 filed Sep. 4, 2014, and claims priority to Netherlands Patent Application No. 2011381 filed Sep. 4, 2013, the disclosures of which are hereby incorporated in their entirety by reference.

FIELD OF THE INVENTION

The invention relates to a method of digitally printing.

The invention further relates to a digital printing system suitable therefore.

BACKGROUND OF THE INVENTION

Digital printing apparatus using liquid developer dispersion—also known as liquid toner—are known from US patent application publication no. 2011/0249990. The known digital printing apparatus comprises a feed roller, a developer roller, developer roller cleaning means, and an image carrying roller; the feed roller being arranged to transfer a quantity of liquid toner from a reservoir onto the developer roller; and the developer roller being arranged to transfer a portion of the quantity of liquid toner onto the image carrying roller in accordance with a charge pattern sustained on a surface of said image carrying roller. A liquid toner residue, also referred to as an excess liquid developer dispersion, remains on (the surface of) the developer roller after the imagewise transfer of the liquid toner from the developer roller to a further roller, particularly the image carrying roller.

In digital printing systems of this kind, it is necessary to remove the liquid toner residue that remains on the surface of the developer roller after contact with the image carrying roller. Any liquid toner residue that remains on the surface of the image carrying roller after contact with a transfer roller of after contact with a substrate needs to be removed as well. Conventionally, use is made of a removal device, such as a scraper, as is disclosed in US2011/0076052A1, paragraph [0044].

It has been observed in preliminary investigations leading to the invention that these highly concentrated and therefore highly viscous compacted toners are not easily decompacted and removed from rollers. Thus, the removal of such a residue can be quite challenging.

Particularly, marking particles in the liquid developer dispersion tend to form lumps in the dispersion resulting in a liquid with a non-uniform distribution of marking particles. This is called caking and often results in an increase of the viscosity of the liquid dispersion. This viscosity increase is significant and could be a tenfold increase or even more.

Liquid developer dispersion that shows caking cannot be used for printing as such and needs to be treated first in order to re-obtain a homogeneously dispersed liquid toner which has similar conductivity and viscosity properties as the starting liquid developer dispersion.

It is thought that caking is the result of marking particles that come so close into each other's neighborhood on the developer roller, so that they start to feel each other's presence and start interacting with each other. Caking can also be the result of injecting charge and applying high shearing forces which are typically present when a thin layer of liquid developer dispersion passes through a very narrow gap between two (rotating) members of the printing apparatus or huge (microsized) mechanical interaction like a cleaning blade scraping on a rotating surface.

The removal of the liquid toner residue starts then to be problematic. As a result, liquid toner residue could remain on the developer roller, which constitutes a contamination and may lead to a non-uniform distribution of fresh developer dispersion resulting in a ghost image and or image quality that is not perfect, in other words incorrect. Specific examples of issues are density instability and incorrect reproduction of fine lines. Removal of the toner residue by a removal device may reduce the issue, but is not known to solve the issue completely. It is therefore a major problem to solve the caking issue.

Unpublished European patent application no. 12 175 762.9 in the name of the Applicant describes the use of an oscillating electric field arranged to substantially decompact the chargeable imaging particles in a liquid toner residue on a developer roller, prior to or during its mechanical removal. Unpublished European patent application no 131625774 in the name of the Applicant describes the use of a loosening member with a rubbing portion, which is arranged to rub the liquid toner residue to be loosened. In use, the rubbing portion is suitably compressed by a development member, particularly the development member. This compression results in absorption of the liquid toner residue in the loosening member, and particularly the rubbing portion thereof. Thereto, the rubbing portion suitably comprises a porous material, such as an elastic foam material.

Unpublished Dutch application NL2010581 in the name of the Applicant describes the addition of an amount of dispersing agent to the excess liquid developer dispersion. This dispersing agent turns out to reduce the viscosity of the excess liquid developer dispersion, and helps to deagglomerate marking particles in the dispersion and/or decrease adhesion of the marking particles to a development member. Therewith the excess liquid developer dispersion is stabilised and its effective viscosity decreased. The amount of the dispersing agent to be added may be controlled on the basis of image information, i.e. when the transferred image is large, less toner residue remains on the development member than when the image is comparatively small. Hence, with a large image, less dispersing agent needs to be added. The dispersing agent is suitably added via a loosening member.

It is desired to improve the treatment process further, so as to facilitate the removal of excess liquid developer dispersion from the development member, in a form that does not harm the recycling of the developer dispersion.

SUMMARY OF THE INVENTION

Accordingly, according to a first aspect, the invention provides a method of digitally printing comprising the steps of:

Transferring a liquid developer dispersion imagewise from a development member via at least one further member to a substrate, which transferred image substantially corresponds to an image to be printed on the substrate, wherein excess liquid developer dispersion remains present on the development member after said imagewise transfer;

Treating the excess liquid developer dispersion so as to facilitate its removal from the development member, wherein the treatment comprises the—patterned—addition of a liquid composition of dispersing agent, wherein the treatment is applied according to a pattern based on the transferred image, and Removing, at least substantially, the treated excess liquid developer dispersion from the development member.

According to a second aspect, the invention provides a digital printing system comprising:

a development member in rotational contact with a further member, said development member and said further member being configured for imagewise transferring liquid developer dispersion from the development member via said further member to a substrate, which transferred image substantially corresponds to an image to be printed on the substrate, and wherein excess liquid developer dispersion remains present on the development member;

treatment means for patternwise treatment of said excess liquid developer dispersion on said development member, which treatment serves to facilitate removal of the excess liquid developer dispersion from the development member;

removal means for removing of the excess liquid developer dispersion from the development member, and control means for controlling the patternwise treatment, comprising a processor for defining a pattern of the treatment based on the transferred image.

According to a further aspect, the invention relates to use of the digital printing system of the invention for the printing of an image to a substrate substantially without caking failure.

The invention is based on the insight that the image information may be used for the definition of an imagewise treatment, i.e. to provide the treatment selectively to those areas that contain much liquid toner residue. The treatment is thus focussed on the areas that need such treatment, and therewith increasing efficiency. Most suitably, the patterned addition involves the addition of a composition comprising a dispersing agent ("dispersing composition").

It is observed that the patternwise treatment does not need to have a pattern or resolution that is identical to the image of the transferred dispersion. Rather, the pattern of the patternwise treatment suitably has characteristic dimensions that are larger than those of the image and/or a lower resolution. The patternwise treatment prepares the liquid toner residue to spread and become again homogeneous.

The resolution of the patternwise treatment may be further defined, dependent on the type of application means for applying the dispersing composition, and may further depend on specific use conditions, such as the used liquid developer dispersion, the rotation speed of the development member, as well as the used dispersing composition and its concentration.

Roughly speaking, the inventors of the present invention envisage at least two different embodiments. The first one is a low-resolution embodiment, according to which the relevant surface area of the development member is subdivided into a limited number of subareas for instance less than 50 subareas, more preferably at most 20 subareas, for instance 10 subareas, or even 8, 4 with a minimum of 2 subareas. The second embodiment is a high-resolution embodiment, according to which the resolution is at most 100 fold, for instance 4-50 fold lower than the resolution used for writing the latent image, typically by means of illumination of an imaging member of the printing system by for example LED or laser. The writing resolution is typically between 600 and 1800 dpi. It will be understood that combinations and variations may be applicable.

In a preferred embodiment of the invention, the pattern is generated by the steps of: (1) Obtaining image information of the transferred image; (2) subdividing said image information over a plurality of available application means; (3) Defining an applicable amount for each application means; and (4) Controlling each application means to apply the defined applicable amount.

These steps are suitably carried out in a controller or a processor coupled thereto or forming part of the controller. The image information is obtained from a memory, or may be otherwise known in the controller, which in one preferred embodiment also controls the formation of the latent image on the imaging member. In the subdivision and subsequent definition step, the amount of excess liquid developer dispersion per subarea is derived from the image, for instance by integration, and a proper amount of the treatment is defined. This amount suitably corresponds to a volume of liquid to be applied by the application means. The number of subareas is suitably at least two.

It is observed for clarity that the development member suitably rotates and that therefore the image may be considered as a series of consecutive rows. The subareas into which the treatment and particularly the addition of dispersing composition is subdivided, are therefore more particularly subareas within a single row. However, in dependence of the resolution of the patternwise application of dispersing composition relative to the image, a single row of patternwise application may be wider than a single row in the image; i.e. a single row of the patternwise application of dispersing composition may correspond to a plurality of consecutive rows in the image.

It is furthermore observed that the definition of the applicable amount per subarea involves in a first embodiment an integration step to specify an expected amount of excess liquid developer dispersion within said subarea, and on the basis thereof, setting the applicable amount. More advanced algorithms may be used. Such algorithms could for instance take into account neighbouring subareas, and/or an overall needed amount of dispersing composition per row as based on the overall amount of liquid toner residue.

The provision of dispersing agent is preferable most in non-image areas, i.e. areas that are outside the area of the transferred image. It is though observed that some transfer may also occur in such non-image areas. Typically, in printing processes based on liquid toner, the liquid toner is charged prior to the transferring step. The charging tends to give rise to a subdivision of the liquid developer dispersion, into a first layer that is enriched in marking particles and a second, outer layer that is enriched in carrier liquid. Particularly due to the contact between the development member and the further member, transfer of especially the outer layer of the charged liquid developer dispersion may occur in the non image areas.

The application means can be of various types. Suitably use is made of nozzles, particularly nozzles known per se from inkjet printers. Suitably, use is made of a nozzle comprising a piezo-electric head, so as to ensure a maximum lifetime with minimum maintenance. In one further embodiment, the nozzle is frequency controlled so as to define a number of ejected droplets per unit area. In other words, it is not merely feasible to make a choice between on or off, but also to make a choice between 1, 2, 3 or even 4 droplets per unit area.

The application means may be present in a single row. However, it may be suitable for both area optimization and speed, that the application means are provided in two or more subsequent rows.

One advantage of the control of the volume of the dispersing composition is that the volume of dispersing composition may be specified by the control means in dependence of user-related settings, such as the type of the marking particles used (which for instance relates to the color of the liquid toner). It will be furthermore understood that the image-wise and patterned application of dispersing agent offers more flexibility with respect to choice of liquid developer dispersions as well as dispersing compositions.

Another embodiment of application means is for instance based on a chamber having a plurality of outlets for localized application of dispersing composition. Each of said outlets is herein provided with a valve, of which the state (open/closed) is controlled by the control means. The chamber suitably contains in use the dispersing composition, more preferably in overpressure through the action of a pump, so that said dispersing composition is ejected upon opening of a valve. The outlet may be shaped as a single hole, or as a plurality of holes, or as one or more channels. The chamber may be provided an inlet for dispersing agent and an inlet for carrier liquid, for instance, and with mixing means, so as to define a concentration of the dispersing composition. Alternatively, the dispersing composition may be provided to the chamber in a desired concentration.

Rather than a single chamber, a plurality of chambers could be provided, if this is more feasible. If the operation speed of the valves would be slow relative to the rotation speed of the development member, the design of the chamber and the configuration of valves could be optimized so as to drive valves in a sequence of two, three or four consecutive rows. The arrangement of outlets of the chamber in such consecutive rows could furthermore be alternated.

The application means may be arranged at different locations relative to the development member. Suitably, the application means are arranged downstream for the area of transfer to the further member. The application means can be arranged directly to the development member or be arranged to an additional member, so that the dispersing composition is transferred to said development member after application onto said additional member. Such additional member is suitably in rotational contact with the development member.

It is observed that optimized cleaning and conditioning arrangements for a photoconductor or image member are known per se without addressing the problem of caking on the development member, and for dry toner, such as for instance from JP2005-331856A1. The effective use and composition is then also rather different from the invention. For instance JP2005-331856A1 relates to the application of a lubricant prior to providing developer, so as to improve transferability from the photoconductor to the further transfer member. Such is also not feasible in the invention, since the transferability problem does not occur, and the liquid developer dispersion does not have any issue. Rather, the application of a salt such as zinc stearate would most likely create problems in charging.

More preferably, the additional member is a loosening member with a rubbing portion of an elastic material, such as a porous material, and more specifically a porous foam material. A quasi-immediate distribution of the dispersing agent through the liquid toner residue can thus be achieved by the mechanical action at the nip of the loosening member and development member, resulting in optimum improvement of the homogeneity of the liquid toner residue—which in that situation becomes again a true liquid developer dispersion.

The rubbing portion may be provided at the surface with holes, cavities, or channels configured for containing liquid toner during compression. In that way, also non-foam materials may be used to obtain similar effects. The surface of the rubbing portion could e.g. be provided with slits or channels or perforations in which liquid toner present on the development member can enter upon contact with the rubbing portion.

The loosening member may furthermore be a brush roller with bristles to mechanically break up toner particle aggregates that may be formed as a result of physical and electrophoretic compaction. The bristles are adapted to contain the liquid toner while being pressed against a first roller, and to perform a rubbing action on the liquid toner. An actuator may be present for moving the loosening member such that liquid toner absorbed or contained in or on the rubbing portion is rubbed during the movement of the loosening member. According to a preferred embodiment, the loosening member is a rotatable member being in operation in rotating contact with the development member. The actuator may then be configured for rotating the loosening member.

According to a preferred embodiment, seen at an area of contact between the development member and the loosening member, the loosening member rotates in an opposite direction, compared to the development member. In that way, a liquid pickup zone is created upstream of the area of contact between the development member and the loosening member, and a squeeze-out zone is created downstream of said area of contact. Such an embodiment has the advantage that the loosening member also fulfills the function of picking up liquid toner from the development member, as well as of removing the picked up liquid toner from the loosening member. In preferred embodiments, the contact between the development member and the loosening member is such that a nip is created between the development member and loosening member. When a quantity of liquid present on the development member arrives at the nip, it will be taken up in the nip, and rubbed and agitated in the nip as a consequence of the counter rotating loosening member. The loosened liquid toner is picked up at one end of the nip by the counter rotating loosening member, and, after a full rotation of the loosening member, is reintroduced in the nip, at the other end thereof, and squeezed out of the rubbing portion.

Preferably the loosening member is a roller, and the rubbing portion is provided as a cylindrical outer layer of the roller. The thickness of this cylindrical outer layer is preferably more than 3 mm.

Furthermore, the development member may have a first rotational speed which is different from a rotational speed from the loosening member. Typically, the speed of the loosening member will be chosen so that a good compromise is obtained between performance and wear behavior.

Preferably, the absolute value of the speed of the loosening member is larger than 0.20 times the absolute value of the speed of the development member, e.g. between 0.20 and 1.0 times the speed of the development member.

According to a further aspect, the invention relates to a method of driving application means for patternwise disposal of a liquid onto a development member of a printing system, said development member containing at its surface excess liquid developer dispersion. This method comprises the steps of:

Obtaining image information of the transferred image;

Subdividing said image information over a plurality of available application means Defining an applicable amount for each application means, and Controlling each application means to apply the defined applicable amount.

This driving method is suitably used in combination with the digital printing system according to the invention, and applicable embodiments discussed with reference to the printing system and the printing method also apply to the driving method.

BRIEF INTRODUCTION OF THE FIGURES

These and other aspects of the invention will be further elucidated with reference to the figures, which are diagrammatical in nature and not drawn to scale and wherein.

DETAILED DISCUSSION OF ILLUSTRATED EMBODIMENTS

Figure 1:
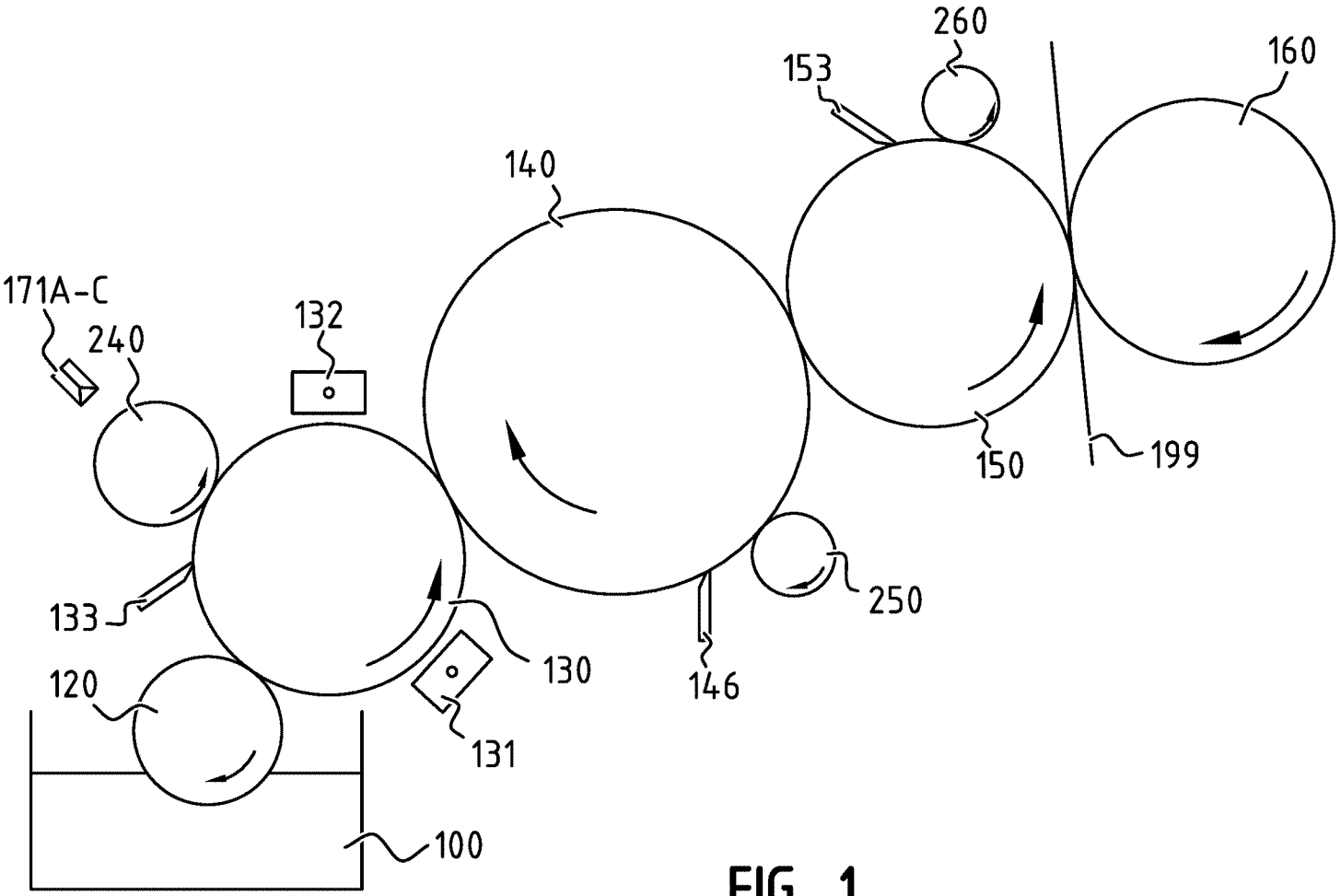
FIG. 1 is a schematic view illustrating a first embodiment of the invention.

The Figures are not drawn to scale and purely diagrammatical in nature. Equal reference numerals in different Figures refer to equal or corresponding features.

FIG. 1 illustrates diagrammatically a first embodiment of a digital printing apparatus of the invention, comprising a liquid developer dispersion reservoir 100, a feed member 120, a development member 130, an imaging member 140, an intermediate member 150 and a support member 160. A substrate 199 is transported between intermediate member 150 and support member 160. Both the development member 130 and the imaging member 140 and also the intermediate member 150 can function as the development member according to the invention, and are shown as provided with removal devices 133, 146, 153, and with treatment means 132, 240, 250, 260. Without loss of generality, the aforementioned members are illustrated and described as rollers, but the skilled person understands that they can be implemented differently, e.g. as belts.

In operation, an amount of liquid developer dispersion, initially stored in the liquid developer dispersion reservoir 100, also called a main reservoir, is applied via the feed member 120, to the development member 130, the imaging member 140, and the optional intermediate member 150, and finally to the substrate 199. The development member 130, imaging member 140, and intermediate member 150 all transfer part of the liquid developer dispersion adhering to their surface to their successor; the part of the liquid developer dispersion that remains present on the member's surface, thus the excess liquid developer dispersion is removed after the transfer stage by appropriate means. These means are schematically illustrated as respective removal devices 133, 146, 153.

The charging of the toner on the development member 130 is done by charging device 131. This charging device 131 can be a corona or a biased roll. By charging the toner the liquid developer dispersion splits into a more marking particles rich layer at the surface adjacent of the development member 130 and a more carrier liquid rich layer as the outer layer.

In this invention, when is referred to a concentration of "liquid developer dispersion" it refers to a concentration wherein the liquid developer dispersion has a solid content so that it can be used as such in a digital printing process. In other words, the liquid developer dispersion according to the invention has a solid content that is at working strength and does not require a dilution. A typical solid content of a liquid developer dispersion is a solid content of between 10 to 30 wt %, such as a solid content of 25 wt %. According to this invention, "solid content" means the amount of marking particles in wt % with regard to the total liquid developer dispersion. According to this invention, "excess liquid developer dispersion" is the liquid developer dispersion that remains present on the surface of a member, such as the development member 130, after a part of liquid developer dispersion has been transferred to another member, such as the imaging member 140.

Upon transfer of the liquid developer dispersion from the development member 130 to the imaging member 140, excess liquid developer dispersion is left on the development member 130. Ideally, this excess liquid developer dispersion is present only in the non-image areas. However, it is not excluded that a thin layer remains on the development member 130 at the area of the transferred image. The physicochemical state and rheology of the excess liquid developer dispersion is influenced by the charging and also by the concentration of the toner particles, which may have changed i.e. increased due to loss of carrier liquid during the development step i.e. part of the liquid enriched toner layer on the development member 130 is transferred to the imaging member 140 in the development nip at the non-imaging parts.

The stability of the dispersion is of particular relevance. A dispersion is most generally a system comprising two or more phases, wherein one phase (the dispersed phase) is distributed finely into the other phase (the dispersing phase). The dispersion may be stabilized by means of dispersing agents that are on the one side present in the dispersing phase and on the other side present in or coupled to the dispersed phase. If the dispersing agent is not available in sufficient amount or cannot fulfill its function, the particles of the dispersed phase tend to agglomerate. Then the dispersion is said to be or become unstable. The final result could be that the agglomerated dispersed phase becomes a solid residue that is attached to a surface. Intermediate results may also be that the size of the dispersed particles increases and/or that a partial separation between the liquid of the dispersing phase and the particles of the dispersed phase occurs, resulting in an inhomogeneous dispersion. This inhomogeneity can lead to a tremendous change in the rheology: a homogeneous dispersion mostly flows in its entirely, but the rheology of an inhomogeneous dispersion is in fact dependent on the two separate phases. In other words, the behavior of a dispersion that becomes inhomogeneous is highly complex, and its flow behavior is rather unpredictable without significant (experimental) investigation.

In the context of the present invention, the liquid toner is a dispersion of marking particles in a carrier liquid. The marking particles, according to this invention, comprise colored particles (also called ink particles or pigment) and a binder resin. The binder resin is a polymer, preferably transparent, that embeds the ink particles and optionally other compounds like melt rheological adjustment compounds or fillers. The marking particles are particles with a diameter of typically about 0.5 to 4.0 μm. The marking particles have a concentration of about 40-95% of the binder resin. Preferably a polyester resin is used as binder resin.

Also other types of resin having a very low or no compatibility with the carrier liquid and dispersing agent can be used. Preferably, the resin has a high transparency, provides good color developing properties and has a high fixing property on the substrate. The carrier liquid according to the invention, can be any suitable liquid as is known in the art, and may be silicone fluids, hydrocarbon liquids and vegetable oils, or any combination thereof.

The concentration of toner particles (solid content) in excess liquid developer dispersion will vary depending on the amount of marking particles that need to be developed. The two most extreme situations of developing are that all the liquid developer dispersion is developed, or none of the liquid developer dispersion is developed. The latter results in a substrate without printed image. When no liquid developer dispersion is developed and all the marking particles remain on the development member and thus reside in the excess liquid developer dispersion, the solid content is higher than in the liquid developer dispersion, particularly due to the partial removal of the carrier liquid containing some dispersing agent in the non-image areas. On the contrary, if all the liquid developer dispersion is developed, the excess liquid developer dispersion remaining on the development member will comprise almost no marking particles resulting in an excess liquid developer dispersion that mainly comprises carrier liquid containing also some dispersing agent. A person skilled in the art will understand that the solid content and the concentration of the carrier liquid in the excess liquid developer dispersion will vary between these two extremes depending on what needs to be developed. Typically, during the printing process a certain amount of carrier liquid is lost because it is highly unlikely that one prints continuously 100% page coverage all the time for all colors. Typically, the viscosity of the excess liquid developer dispersion is increased compared to the viscosity of the starting, i.e. 'fresh' liquid developer dispersion. The increase of the viscosity is due to the loss of carrier liquid and dispersing agent and due to caking. Caking causes a structural change in the liquid developer dispersion and has a significant contribution to the increase of viscosity of the excess liquid developer dispersion.

When reference is made to a concentration of dispersing agent or another compound in excess liquid developer dispersion in wt %, in this invention, this refers to a concentration of dispersing agent or another compound compared to the weight of excess liquid developer dispersion that remains on the member, unless it is clear that something else is meant.

In accordance with the invention, treatment means are present for treating the excess liquid developer dispersion. The treatment of the excess liquid developer dispersion is aimed at facilitating its removal. Particularly, use is made of mixing and adding components such as a dispersing agent and carrier liquid, to improve the dispersability of the dispersed phase.

It has been found that the addition of carrier liquid and dispersing agent can be perfectly combined with recycling of the toner. This is preferably implemented in that the removed mixture of excess liquid developer dispersion comprising the added dispersing composition is processed to obtain a required concentration. The process comprises mixing so as to prepare a homogeneous dispersion. Only thereafter, the developer dispersion will be ready for reuse and has the same properties again as a fresh liquid developer dispersion immediately after dilution of the concentrate.

FIG. 1 shows the treatment means 132 such as discharging corona 132 which is provided downstream of the area of the rotational contact between the development member 130 and the imaging member 140. The discharging corona 132 is suitable for changing/removing the charge in the dispersion. Further, downstream of the discharging corona 132 there is provided the treatment means 240 as an additional member 240. In this example, the additional member is embodied as a loosening roller. This is a specific means for adding of dispersing agent, which, on the basis of its rubbing portion, results in mixing of the excess liquid developer dispersion (and any caking or residue therein) with the newly added dispersing agent. The loosening roller 240 is, in use, in rotational contact with the development member 130. The treatment means 250, 260 are present as similar loosening rollers which could be simply addition rollers without a dedicated rubbing portion, in rotational contact with the imaging member 140 and the intermediate member 150 respectively. Thereafter, the removal device 133 is present, which most suitably is a scraper.

According to the invention, a composition of dispersing agent is applied. As shown in FIG. 1, the composition of dispersing agent is added to the additional member 240. It is observed for sake of clarity that the terms "composition of dispersing agent" and "dispersing composition" are used as synonyms. The dispersing composition is particularly a liquid composition. The dispersing composition may be in the form of a dispersion, but is more suitably provided in the form of a solution. The dispersing composition is used with a viscosity that is suitable for its application, particularly by means of nozzles. The dispersing composition is furthermore used in a concentration that is suitable for facilitation of the removal of the toner residue. The concentration and the type of dispersing agent may depend on the liquid toner in use, and could be different for instance for a magenta toner and a black toner. The concentration of the dispersing composition is preferably such that the recycling process results in fresh liquid developer dispersion in a suitable quantity and with a concentration in the required, predefined range. A suitable concentration is between 0.005 wt % and 0.5 wt %, preferably between 0.01 wt % and 0.3 wt %, most preferably between 0.02 wt % and 0.2% wt of added dispersing agent with regard to the total weight of excess liquid developer dispersion.

It is observed for clarity, that the excess liquid developer dispersion on the development member is an effectively un-used dispersion, though it is typically charged before the transfer step and may have been decharged thereafter. As a consequence, the layer thickness of the excess liquid developer dispersion is larger than the layer thickness of any toners on the imaging member. This makes the correct removal of the caked excess liquid developer dispersion on the development member more difficult.

The dispersing agent used in the dispersing composition is in one suitable embodiment a polymeric dispersing agent, and more preferably a dispersing agent comprising a polyethylene imine or polyallylamine backbone. The dispersing agent may further be based on a polyhydroxystearate and/or polycaprolactone. The polymer may be a homopolymer, a copolymer, which is either a random copolymer or a block copolymer. For instance a random copolymer of vinylpyrrolidone and long chain olefins may be used. Moreover, the polymeric dispersing agent may contain dispersing functional groups that have been grafted onto a backbone. The backbone is for instance a binder polymer suitably for use in combination with marking particles. Alternatively, the dispersing agent is ester-based, such as for instance based on fatty acids. Sorbitan esters constitute a suitable example. Typical examples of dispersing agents are solsperse 11000, solsperse 13490, solsperse 11200, Antaron V220, Ajispers 817, tilosperse 8300 or tilosperse 13000, which dispersing agents are commercially available. The dispersing composition may further contain a plurality of dispersing agents.

The dispersing agent of the dispersing composition is most suitably a "free" dispersing agent, i.e. one that is not bound to marking particles, such as in a toner dispersion. Typically, in a liquid toner dispersion, the dispersing agent is processed with the marking particles so as to achieve such binding, for instance by a milling step as part of the mixing or even by mixing the dispersing agent into the marking particles. Free dispersing agent is typically dispersing agent dissolved in carrier liquid, or even a composition primarily comprising dispersing agent. Free dispersing agent may be stated to be a dispersing agent that is capable of dispersing activity, but does not—at least not substantially—fulfill such dispersing activity, since it is present in a single phase only.

The dispersing composition furthermore can comprise a carrier liquid, which most suitably acts as a solvent for the dispersing agent for example when the viscosity of the dispersing agent is too high. The carrier liquid is preferably identical to the carrier liquid of the fresh liquid developer dispersion. The carrier liquid is for instance a mineral oil, vegetable oil, a silicone fluid. In case that the liquid developer dispersion comprises more than one carrier liquid (thus, a mixture of 'solvents'), the dispersing composition could contain either one of said carrier liquids or a combination thereof. In the event that the liquid developer dispersion contains further additives, such additives may be present in the dispersing composition. However, it is deemed preferable to add such additives only after reworking the mixture of dispersing composition and toner residue into fresh liquid toner.

The dispersing composition is applied onto the additional member 240 in a patterned manner with application means 171A, 171B, 171C. As shown in this diagrammatical FIG. 2, all of said application means 171A, 171B, 171C are under control of a control means 200. While the control is herein shown as separate lines, the control and driving of the application means 171A-171C may be effected by multiplexing of driving signals on a single bus communication line (such as I2C). The application pattern is derived from the image applied to the imaging member 140. As will be understood, image information is available in a computer 210, e.g. in a memory and/or in a processor of the computer 210 of the digital printing system. The derivation of the pattern from said known image involves various processing steps. The pattern most suitably corresponds to the non-image areas, because the composition is particularly needed in areas where the liquid toner has not been transferred to the imaging member 140.

Roughly speaking, the pattern may thus be largely corresponding to a negative of the transferred image, i.e. to the non-image areas. However, there may be situations and optimizations of the pattern that deviate from this negative. The resolution needs to be modified so as to be in correspondence with the ability of the application means 171A-C and the needs of the application. This ability is not merely dependent on any specific tool, such as a nozzle, but also on the number of tools in the application means 171A-C and the speed at which the additional member 240 rotates.

The application means 171A-C are particularly embodied as a plurality of nozzles that are directed towards the additional member 240. The nozzles are more preferably nozzles of the type used in inkjet printers, more preferably comprising piezoelectric heads. Though here shown that the application means 171A-C provide the composition of dispersing agent to the additional member 240, it is not excluded that the application means 171A-C are directed to the development member 130 directly (e.g. before or after the discharging corona 132 or just before removal device 133).

Figure 2:
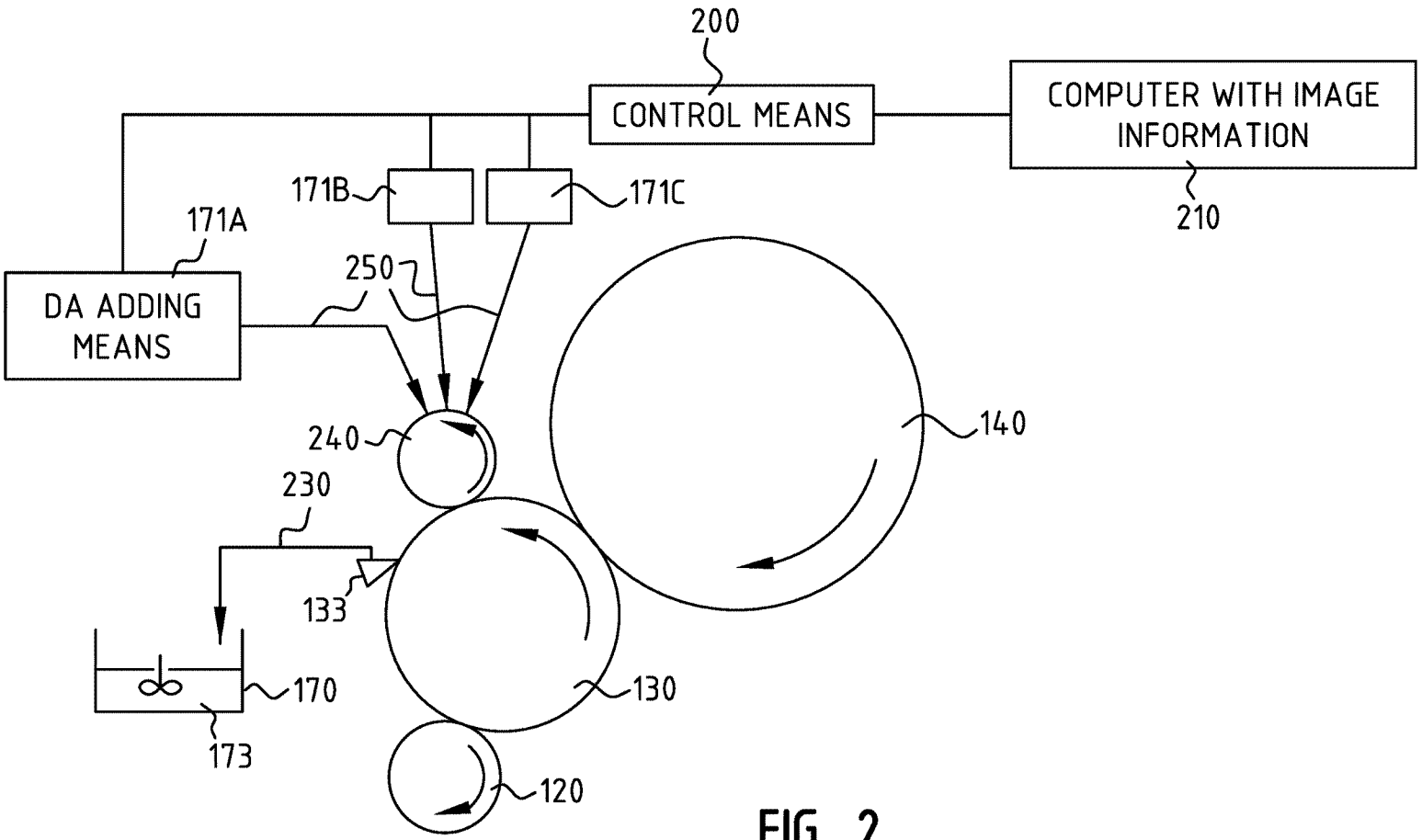
FIG. 2 is a schematic view illustrating the first embodiment of the invention in more specific view.

FIG. 2 shows in cross-sectional, schematic view the first embodiment according to the invention in more specific view. As shown in this FIG. 2, the composition of dispersing agent is added by application means 171A-C via different independent controllable ejecting lines 250 to the additional member 240 that is in rotational contact with the development member 130, which acts in this example as the development member. The additional member 240 is most suitably provided with a rubbing portion and is moreover configured for transferring dispersing agent, particularly in a liquid form on the basis of a carrier liquid, to the development member 130.

FIG. 2 is further shown to contain a container 170 for a solution or dispersion of dispersing agent and liquid toner 173. This container 170 is suitably stirred so as to ensure mixing of excess dispersing agent that has been removed from the development member 130 with removal device 133. The removal device 133 suitably comprises a scraper, as well as a guiding member 230 towards the container 170. The container 170 may further be provided with further inlets, for instance with concentrated toner and with carrier liquid with or without dispersing agent and/or further additives. In this manner, the mixing may result in fresh liquid toner that may be added to the main reservoir 100 as shown in FIG. 1.

It has been found that the provision of a dispersing composition to the toner residue, particularly via additional member 240 and localized to the places where the image was not developed, leads to a surprisingly large reduction in viscosity of the toner residue. Experiments have shown that the use of a dispersing composition in a concentration of 0.2 wt % or even less relative to the weight of the excess liquid developer dispersion, is sufficient for a reduction of the viscosity by 25% or more, particularly at lower shear rates such as below 100/s, for instance below 10/s, when starting with excess liquid developer dispersion that is characterized by caking. Experimental evidence hereof was obtained by the Applicant and is part of the non pre-published Dutch patent application NL20100581 that is included herein by reference.

The additional member 240 and the development member 130 are shown to rotate in the same rotation direction. However, this is not deemed to be essential, and the rotation directions of both members 130, 240 could be opposed, the latter being the preferred rotation direction.

Figure 3:
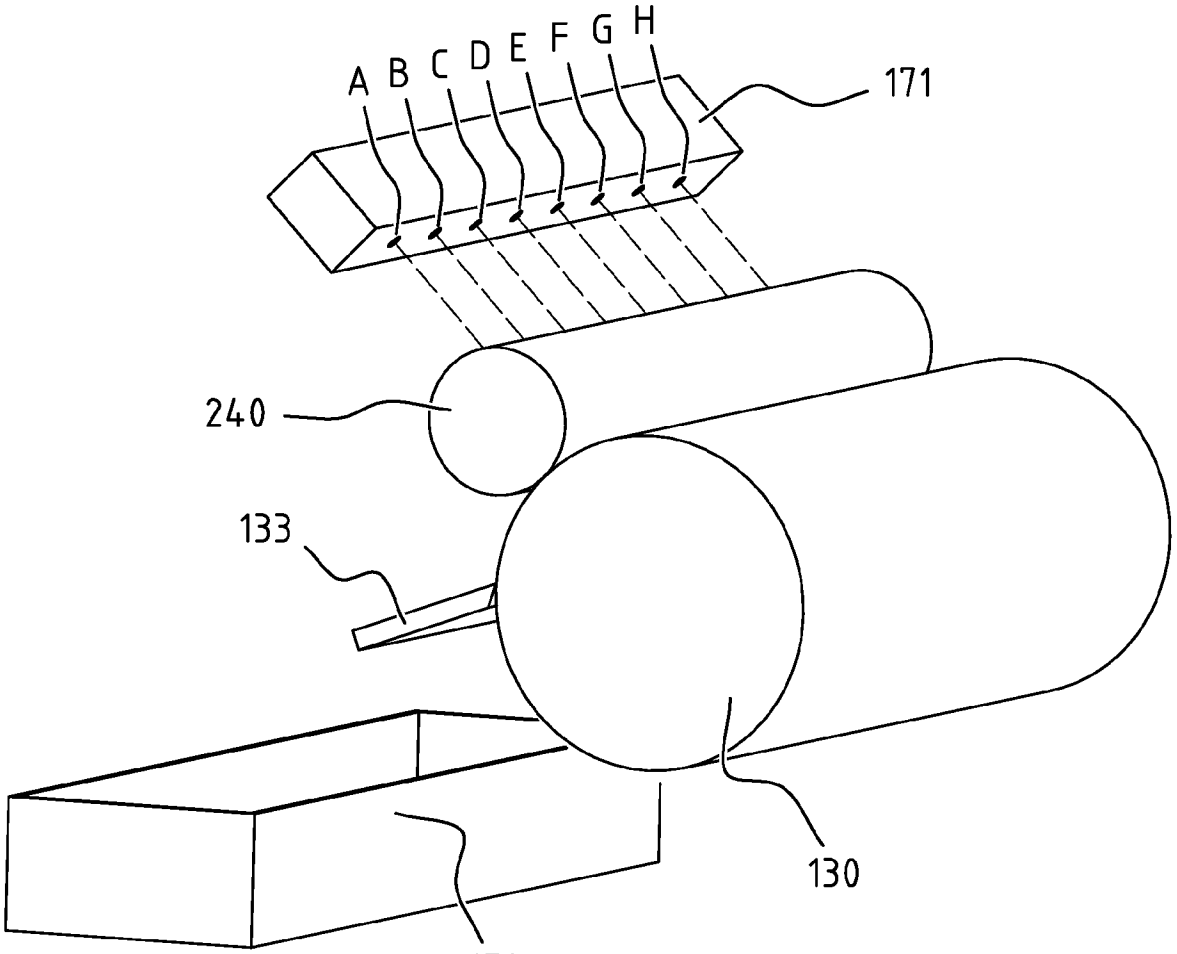
FIG. 3 is a schematic view in a bird's eye perspective of an embodiment of the invention.

FIG. 3 shows diagrammatically, in a schematical bird's eye view a further embodiment of the invention. In comparison with FIGS. 1 and 2, FIG. 3 merely discloses some of the members, in order to keep the figure simple. FIG. 3 shows application means 171 for the patternwise application of an agent, such as a dispersing agent. The agent, suitably in the form of a composition, is applied to the additional member 240 that is in rotational contact with the development member 130. Agent applied to the additional member 240 is subsequently transferred to the development member 130 and onto the toner residue (excess liquid developer dispersion) on the surface of this development member 130. Suitably, the additional member 240 is provided with a rubbing portion (not shown) so as to improve mixing of the agent with the toner residue. The thus treated toner residue is subsequently removed from the development member 130 by means of the removal device 133. As shown in FIG. 3, the removal device 133 comprises a tip substantially in contact with the development member 130 as well as a guide member for guiding the treated toner residue to the container 170.

The application means 171 are in this example embodied as a chamber provided with a plurality of outlets A-H. In this example, the number of outlets is eight, and they are present in a single row across the width of the development member 130, as well as the additional member 240. Each of the outlets is provided with a valve (not shown), preferably at the outside of the chamber. The valve is under control of control means, so that the agent, here a dispersing composition, is patternwise applied to the additional member 240. Due to the structure of the additional member 240, and its rotation, the composition may somewhat spread out. However, this spreading is deemed controllable and by not means taking away the effect of patterned application. The localized, patterned provision of dispersing composition allows provision of the composition where needed without using an excess that would particularly reduce the concentration in the container 170, and therewith reduce its feasibility or its ease of recycling into 'fresh' liquid toner. The application means 171 are suitably provided with a pump and with inlets for supply of the agent, such as a dispersing composition In short, the invention provides a digital printing system that comprises a development member in rotational contact with a further member for imagewise transferring liquid toner from the development member optionally via said further member to a substrate. The system is such that toner residue remains on the development member after the transfer. Treatment means are present for patternwise treatment of said toner residue on said development member, especially by addition of a dispersing agent, so as to facilitate removal of the toner residue by means of removal means. Control means are present for controlling the patternwise treatment. The system is used for robust and continuous printing, without negative impact of caking of the toner residue and is suitable for recycling of the toner residue into liquid toner.

The invention claimed is:

1. A method of digitally printing comprising the steps of:

transferring a liquid developer dispersion imagewise from a development member to a substrate, which transferred image substantially corresponds to an image to be printed on the substrate, wherein excess liquid developer dispersion remains present on the development member after said imagewise transfer;

treating the excess liquid developer dispersion so as to facilitate the excess liquid developer dispersion's removal from the development member, wherein the treatment comprises the patterned addition of a liquid composition comprising a dispersing agent, wherein the treatment is applied according to a pattern based on the transferred image, and removing, at least substantially, the treated excess liquid developer dispersion from the development member.

2. The method as claimed in claim 1, wherein the agent is added to an additional member in rotational contact with the development member, and is transferred then to the development member.

3. The method as claimed in claim 2, wherein the addition of the agent is carried out by means of printing with inkjet nozzles.

4. The method as claimed in claim 2, wherein the addition of the agent is carried out by means of ejecting from a chamber provided with a plurality of outlets provided with valves for controlled opening and/or closure.

5. The method as claimed in claim 2, wherein the pattern is generated by the steps of obtaining image information of the transferred image;

subdividing said image information over a plurality of available applicators;

defining an applicable amount for each applicator, and controlling each applicator to apply the defined applicable amount.

6. The method as claimed in claim 1, wherein the addition of the agent is carried out by means of printing with inkjet nozzles.

7. The method as claimed in claim 6, wherein an ejecting frequency of the nozzles may be controlled, so as to vary a number of ejected droplets within a time unit.

8. The method as claimed in claim 1, wherein the addition of the agent is carried out by means of ejecting from a chamber provided with a plurality of outlets provided with valves for controlled opening and/or closure.

9. The method as claimed in claim 1, wherein the pattern is generated by the steps of obtaining image information of the transferred image;

subdividing said image information over a plurality of available applicators;

defining an applicable amount for each applicator, and controlling each applicator to apply the defined applicable amount.

10. The method as claimed in claim 9, wherein at least two applicators are present, which are arranged to apply an applicable amount selectively to a predefined area along a length of the development member.

11. The method of claim 1, wherein the liquid developer dispersion is transferred imagewise from the development member via at least one further member to the substrate.

12. A digital printing system comprising:

a development member in rotational contact with a further member, said development member and said further member being configured for imagewise transferring liquid developer dispersion from the development member to a substrate, which transferred image substantially corresponds to an image to be printed on the substrate, and wherein excess liquid developer dispersion remains present on the development member;

a treatment device for patternwise treatment of said excess liquid developer dispersion on said development member, which treatment serves to facilitate removal of the excess liquid developer dispersion from the development member;

a removal device for removing of the excess liquid developer dispersion from the development member, wherein said treatment device comprises a plurality of applicators for application of a liquid composition comprising a dispersing agent, and a controller for controlling the patternwise treatment, comprising a processor for defining a pattern of the treatment based on the transferred image.

13. The digital printing system as claimed in claim 12, wherein the controller is configured to control the patterned treatment by means of driving of said applicators individually.

14. The digital printing system as claimed in claim 13, wherein said applicators are embodied as inkjet nozzles.

15. The digital printing system as claimed in claim 12, wherein the treatment device further comprises an additional member in rotational contact with said development member, and wherein the plurality of applicators is arranged for application of said agent to the additional member.

16. The digital printing system as claimed in claim 12, wherein said applicators are embodied as inkjet nozzles.

17. The digital printing system of claim 12, wherein said development member and said further member are configured for imagewise transfer of said liquid developer dispersion from the development member via said further member to the substrate.

18. A method of driving applicators for patternwise disposal of a liquid composition comprising a dispersing agent onto a development member of a printing system, said development member containing at its surface excess liquid developer dispersion, comprising the steps of:

obtaining image information of the transferred image along a length of the development member;

subdividing said image information over a plurality of available applicators;

defining an applicable amount for each applicator, and controlling each applicator to apply the defined applicable amount.

19. The method of claim 18, wherein said applicators are embodied as inkjet nozzles.

20. The method of claim 18, wherein controlling each applicator comprises controlling an ejecting frequency of an inkjet nozzle.

* * * * *